US011555355B2

(12) United States Patent
Vincent, Sr. et al.

(10) Patent No.: US 11,555,355 B2
(45) Date of Patent: Jan. 17, 2023

(54) METHOD AND APPARATUS FOR LOW DISPLACEMENT, HYDRAULICALLY-SUPPRESSED AND FLOW-THROUGH SHOCK DAMPENING

(71) Applicant: DrilTech, L.L.C., Youngsville, LA (US)

(72) Inventors: Bradley Jay Vincent, Sr., Lafayette, LA (US); Patrick Sean Killeen, Lafayette, LA (US)

(73) Assignee: DRILTECH, L.L.C., Youngsville, LA (US)

( * ) Notice: Subject to any disclaimer, the term of this patent is extended or adjusted under 35 U.S.C. 154(b) by 284 days.

(21) Appl. No.: 17/091,509

(22) Filed: Nov. 6, 2020

(65) Prior Publication Data

US 2021/0140303 A1 May 13, 2021

Related U.S. Application Data

(60) Provisional application No. 62/932,977, filed on Nov. 8, 2019.

(51) Int. Cl.
*E21B 17/07* (2006.01)
*E21B 47/017* (2012.01)
(Continued)

(52) U.S. Cl.
CPC ..... *E21B 17/07* (2013.01); *E21B 34/06* (2013.01); *E21B 47/017* (2020.05); *E21B 23/04* (2013.01)

(58) Field of Classification Search
CPC .. E21B 47/014; E21B 47/0175; E21B 47/013; E21B 47/01; E21B 34/06; E21B 17/07; E21B 47/017; E21B 23/04
See application file for complete search history.

(56) References Cited

U.S. PATENT DOCUMENTS 4,186,569 A * 2/1980 Aumann ..... F16D 3/06 175/321
6,016,288 A 1/2000 Frith
(Continued)

FOREIGN PATENT DOCUMENTS

FR 1405898 A 7/1965
SU 911066 A1 3/1982

OTHER PUBLICATIONS

PCT International Preliminary Report on Patentability dated May 19, 2022 (copy attached).
(Continued)

*Primary Examiner* — George S Gray
(74) *Attorney, Agent, or Firm* — Ted M. Anthony

(57) ABSTRACT

An inline shock dampener apparatus is configured to absorb energy from encountered axial shock events and subsequently release this energy in a controlled fashion. The inline shock dampener apparatus can be included, for example, as part of a measurement while drilling ("MWD") or other downhole drilling assembly, and dampens these shock events by absorbing shock energy into an absorbing medium such as springs or elastomers and hydraulically-suppressing the recoil energy stored during the said shock event. Additionally, the inline shock dampener permits fluid to flow through an internal fluid flow path with little or no change to the internal flow path's volume, pressure, or effective flowrate.

14 Claims, 7 Drawing Sheets

(51) Int. Cl.
*E21B 34/06* (2006.01)
*E21B 23/04* (2006.01)

(56) References Cited

U.S. PATENT DOCUMENTS

| | | | | |
|---|---|---|---|---|
| 6,247,542 | B1 | 6/2001 | Krueger et al. | |
| 6,412,614 | B1 | 7/2002 | Lagrange et al. | |
| 7,564,741 | B2 | 7/2009 | Schmidt et al. | |
| 8,622,153 | B2 | 1/2014 | Swietlik et al. | |
| 8,640,795 | B2 | 2/2014 | Jekielek | |
| 9,458,679 | B2 | 10/2016 | Wassell et al. | |
| 9,638,025 | B2 | 5/2017 | Pare et al. | |
| 9,644,434 | B2 | 5/2017 | Frith | |
| 10,648,265 | B2 | 5/2020 | Kinsella et al. | |
| 10,704,340 | B2 | 7/2020 | Pratt et al. | |
| 2007/0000696 | A1 | 1/2007 | Laflin | |
| 2011/0061934 | A1 | 3/2011 | Jekielek | |
| 2012/0247832 | A1 | 10/2012 | Devlin et al. | |
| 2013/0168092 | A1* | 7/2013 | Evans | E21B 31/107 166/301 |
| 2016/0194917 | A1 | 7/2016 | Donoghue et al. | |
| 2017/0328142 | A1* | 11/2017 | Pratt | E21B 17/07 |
| 2019/0133858 | A1 | 5/2019 | Tessmer et al. | |

OTHER PUBLICATIONS

PCT International Search Report and Written Opinion dated May 24, 2021 (copy attached).

* cited by examiner

METHOD AND APPARATUS FOR LOW DISPLACEMENT, HYDRAULICALLY-SUPPRESSED AND FLOW-THROUGH SHOCK DAMPENING

BACKGROUND OF THE PRESENT INVENTION

1. Field of the Invention

The present invention pertains to a dampener for absorbing forces associated with shock events. More particularly, the present invention pertains to a downhole shock dampener used in connection with the drilling of oil and gas wells. More particularly still, the present invention pertains to a zero displacement, hydraulically suppressed downhole shock dampener.

2. Description of Related Art

Shock dampeners are commonly used in various applications across many different industries and operational settings to suppress motion and absorb all or some portion of energy (typically linear and/or radial forces), particularly energy associated with shock events and often along a particular axis. Conventional shock dampening systems frequently comprise a rod having a first end operationally connected to a desired device or tool. The rod is at least partially received within a bore extending through a cylinder or other housing; a shoulder (or a sealing piston, or just seals) is operationally attached to the rod within said bore. The cylinder or housing accommodates the rod entry into said bore and is sometimes crafted to provide a mechanism for sealing fluid internally within said bore.

In turn, the cylinder can be attached to a different device (or component of the original device) through articulating means. A number of individual or combined means can be utilized within said cylinder or housing (such as, for example, gas pressure, coiled springs, disc springs, compressible elastomers, electro-resistive devices, and/or the like) to absorb forces associated with shock events in various directions. Commonly a dampener will have a means to regulate recoil of said rod after a shock event is complete and stored energy contained in a spring (or similar device) is released.

Conventional shock dampeners used in most industries typically do not facilitate an independent fluid flow path through internal components of said dampener. However, some applications do require such an independent flow path to connect devices through the dampener, but are configured such that the dampener's reciprocating motion will change the internal volume, pressure, and/or volumetric flowrate of the fluid transported in that independent flow path.

Such variations in pressure, volume and/or flowrate are frequently problematic in applications where a separate, sealed flow path must exist through the shock dampener, and wherein the pressure, volume, and/or volumetric flowrate of fluid within said flow path must be preserved in order to more precisely control processes or provide metering functions of devices operationally connected to either side of the shock dampener. Additionally, if pressure conditions of such internal fluid flow were to significantly change, such change could in turn negatively impact dampening performance when a shock event is encountered.

Conventional flow through shock dampeners are frequently used in wellbores during downhole drilling (and, more specifically, measurement while drilling or "MWD") operations. In such applications, a conventional flow through shock dampener is frequently placed between a device having a servo valve (typically referred to as a "Pulser") and a flow through piston/cylinder/shaft assembly (typically referred to as a "Mud Valve").

Generally, during such operations, an open servo valve condition in a Pulser allows fluid to enter the region above a Mud Valve piston, thereby driving a piston and shaft of the Mud Valve into a desired position, with the aid of a bias spring, to create a decrease in flow area of a separate flow path in order to generate a positive magnitude fluid pressure signal of a fixed width. After said servo valve in said Pulser is subsequently closed, lower fluid pressure below the induced Mud Valve restriction is communicated through a bore in the shaft to a position above the Mud Valve piston. The higher fluid pressure above the induced restriction in the Mud Valve (external to the Mud Valve's housing) is simultaneously communicated via strategically placed ports extending to the lower end of said piston.

Such differential pressure across the piston generates a "lifting" force that overcomes both dynamic fluid pressure forces and spring forces, thus stroking the piston and shaft out of the induced restricted position and completing a single timed fluid pressure pulse. This timed fluid pressure pulse is essentially a single "bit" of data in an encoding scheme from an MWD tool in a downhole Bottom Hole Assembly (BHA) to a surface computer that decodes a series of these precisely timed pulses into usable data. This process, sometimes referred to as mud pulse telemetry, is commonly used to transmit data measured or recorded downhole to a surface location.

Under extreme drilling conditions frequently encountered in drilling boreholes for oil and gas exploration and geothermal wells, precision instruments used by MWD equipment can be damaged by downhole drilling dynamics. Thus, it is highly desirable to protect these MWD instruments. In order to protect such equipment, multiple shock absorbing devices and features can be incorporated into a MWD assembly, with a flow through conventional shock dampener usually being the first shock absorbing device in this series of shock mitigating features. Depending on the orientation of the MWD instruments relative to a Mud Valve, a shock dampener is primarily designed to absorb shock events either by compressing (typically in a "bottom mount" MWD shouldered in a "landing sub") or extending (typically in a "top mount" MWD suspended from a "hang off sub").

Conventional flow through shock dampener systems typically involve some significant physical displacement during operation. For "bottom mount" MWD systems, shock events generally cause compression of the shock dampener which, in turn, reduces the internal space available between a Pulser and Mud Valve; this effectively simulates an open servo during such compression by pushing fluid towards the mud valve's piston, driving the Mud Valve piston shaft further towards or into the restricted position without an associated servo signal. This can cause a resulting unintended pressure pulse resulting in data quality degradation and, if multiple shock events occur in succession (which can often occur during aggressive excitation of the BHA), decoding quality of the mud pulse telemetry system can be significantly degraded. As a result, synchronization with the surface decoding system can be lost, forcing a recycling of pumps to resynchronize the MWD and surface system.

Digital signal processing has been, and continues to be developed to help filter some of this degradation by evaluating shifts in perceived pulse widths and pulse location. However, any signal processing technique's ability to discriminate between an actual MWD data signal and a shock induced signal becomes increasingly degraded as the programmed pulse width is reduced and approaches the duration of the unintended pressure pulse event.

Thus, there is a need for a flow through shock dampener that can simultaneously absorb energy from encountered shock events, while being run in an inline configuration, allowing the flow of fluid through said shock dampener. Further, said flow though shock dampener should allow for little or no displacement of fluid to this internal inline flow path, and hydraulically-suppress recoil energy during shock dampening motions. Such a flow through shock dampener is described herein.

SUMMARY OF THE INVENTION

Although other applications can be envisioned without departing from the scope of the present invention, in a preferred embodiment, the present invention comprises a shock dampener that can be used in a wellbore during downhole drilling (and, more specifically, measurement while drilling or "MWD") operations. The shock dampener of the present invention can replace an existing flow through shock dampener placed downhole; although other operational applications can be envisioned, the shock dampener of the present invention can be beneficially operationally installed between a device with a servo valve (Pulser) and a flow through piston/cylinder/shaft assembly (Mud Valve).

In a preferred embodiment, the present invention comprises a flow through shock dampener that can be used to absorb some portion of energy from encountered shock events. Said shock dampener can beneficially comprise a "sub" that can be run in an inline configuration, while allowing fluid flow through said shock dampener and, more specifically, a dedicated fluid flow path extending there through. Further, said shock dampener allows for little or no internal flow path fluid displacement, while also hydraulically-suppressing absorbed recoil energy encountered during a shock event.

Because faster data rates (shorter pulse widths) are typically preferable in most applications, it is becoming increasingly difficult to combat shock induced noise—that is, unwanted mud pulses—through conventional digital signal processing alone. By conserving fluid pressure, volume, and flowrate in the space between downhole devices, the shock dampener of the present invention can dramatically improve signal quality while still implementing an active shock dampener in line with a Mud Valve's internal flow path.

The preservation of pressure, volume, and volumetric flowrate by the shock dampener of the present invention effectively eliminates fluid induced stroking of the Mud Valve by not trying to "push" fluid out of the Mud Valve piston region during a compressive stroke of the dampener or, conversely, "pulling" fluid in during the extension stroke of the dampener. In addition, by conserving the fluid pressure, volume, and volumetric flowrate as described herein, the relative performance characteristics of the shock dampener remain constant, even when "lifting" a piston shaft out of its restricted position where very high magnitude (1,500 psi) differential pressures are commonly produced, resulting in more predictable dampening of shock events.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

The inline shock dampener apparatus of the present invention, sometimes referred to herein as a "dampener", comprises an apparatus that can be used in series with one or more other devices—typically in a downhole environment such as, for example, within a subterranean wellbore. Although the dampener of the present invention can be used in other operational applications, it is to be observed that the shock dampener of the present invention can be beneficially installed between a device with a servo valve (Pulser) and a flow through piston/cylinder/shaft assembly (Mud Valve) as part of a downhole MWD assembly.

The shock dampener apparatus of the present invention can be used to substantially mitigate or lessen both mechanical and hydraulic effects of impacts and/or other shock events and, especially, those occurring along the primary longitudinal axis of the dampener, in either or both linear directions. Furthermore, the present invention allows for dampening of impacts and/or shock forces on connected devices above and/or below the inline shock dampener apparatus of the present invention, while permitting simultaneous and individually segregated fluid flow paths to exist through and around (and to permit fluid communication across) said dampener.

Figure 1:
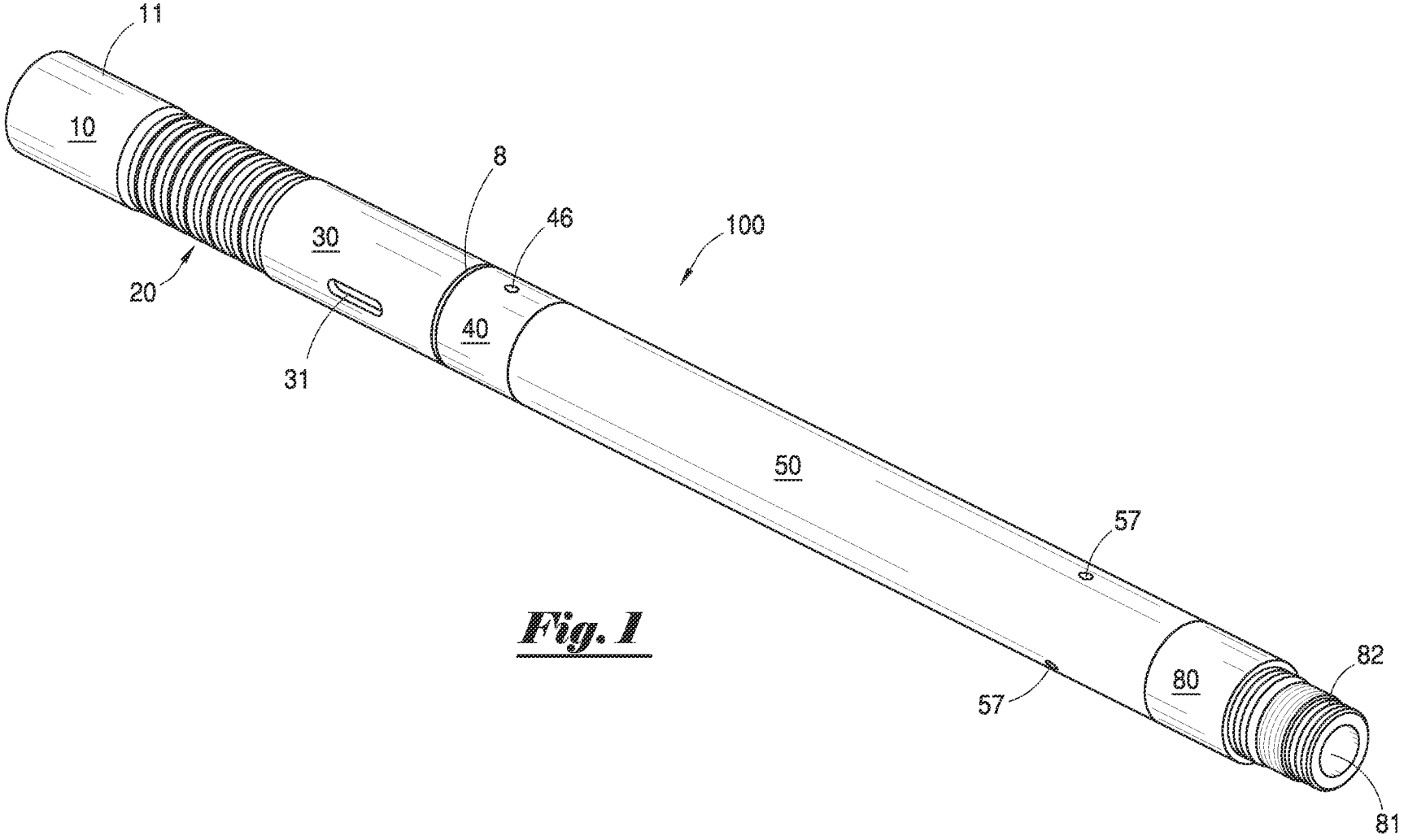
FIG. 1 depicts a side perspective view of a shock dampener apparatus of the present invention.

FIG. 1 depicts a side perspective view of a shock dampener apparatus 100 of the present invention. In a preferred embodiment, dampener 100 of the present invention comprises an assembly, beneficially crafted out of appropriately durable materials, having a substantially cylindrically shaped exterior. Although the size of said dampener 100 can be adjusted to fit specific applications, in a preferred embodiment said dampener 100 has a maximum outside diameter sized to maintain at least a desired annular space or distance between the outer surface of the dampener and the inner surface of a surrounding pipe or wellbore; said annular set off or gap ensures that fluid flow velocities around the dampener remain less than a predetermined design maximum (by way of illustration, but not limitation, 40 feet per second in most applications).

Still referring to FIG. 1, dampener 100 generally comprises a first mandrel 10 defining a head section 11, wherein said head section 11 can comprise a female or "box-end" threaded connection member. Said dampener 100 further generally comprises disk spring assembly 20, key locking sleeve 30 (having at least one key installation slot 31), key body member 40 having side port 46, recoil housing 50 having side port(s) 57, and fluid diversion member 80. Said fluid diversion member 80 generally includes central bore 81, as well as external threads 82; it is to be observed that external threads 82 can comprise a male or "pin-end" threaded connection member as illustrated or a female or "box end" threaded member if so desired.

Still referring to FIG. 1, dampener 100 can be beneficially installed within a downhole MWD assembly. By way of illustration, but not limitation, a first connected device, such as a Pulser or other device having a servo valve, can be operationally attached to one end of dampener 100 by engagement (typically via a mating box-end threaded connection member) using external threads 82. Similarly, a second connected device, such as a Mud Valve, can be operationally attached to the opposite end of said dampener 100 by engagement (typically via a mating pin-end threaded connection member) using internal threads disposed within head 11 of first mandrel 10. Each of the said first and second connected devices is beneficially fastened both mechanically and hydraulically to the dampener 100 as to provide for necessary mechanical and hydraulic integrity.

Figure 2:
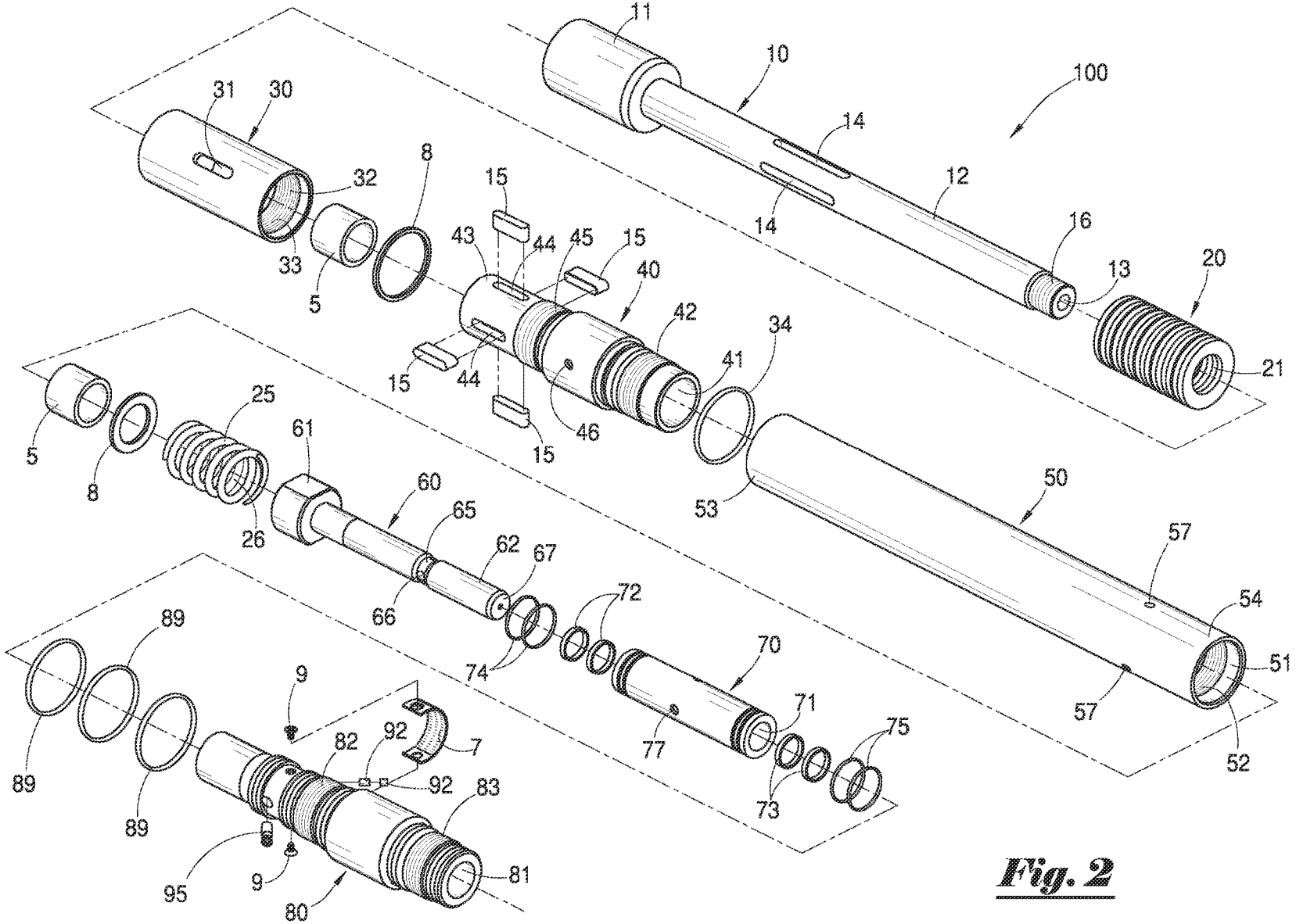
FIG. 2 depicts an exploded perspective view of a shock dampener apparatus of the present invention.

FIG. 2 depicts an exploded perspective view of dampener 100 of the present invention. Dampener 100 generally comprises substantially cylindrical first mandrel 10 and substantially cylindrical second mandrel 60; said first mandrel 10 and second mandrel 60 are aligned along their longitudinal axes and connected to each other, wherein said connection forms a sufficiently rigid mechanical attachment and a sufficient fluid pressure seal.

First mandrel 10 generally comprises head member 11 and substantially cylindrical body section 12; said head member 11 has a larger outer diameter than said body section 12. A central through bore 13 extends though body section 12 and head member 11. Although not visible in FIG. 2, it is to be observed that head member 11 has internal threads that form a female or "box-end" threaded connection member. First mandrel 10 also has external threads 16 at its distal end; it is to be observed that said external threads 16 form a male or "pin-end" threaded connection member. At least one elongated key slot(s) 14 extends along the outer surface of said body section 12. In a preferred embodiment, said key slot(s) 14 is oriented parallel to the longitudinal axis of said body section 12.

A plurality of disc springs are oriented in a combined series/parallel stacking arrangement to form disc spring assembly 20. Said disc spring assembly 20 has a substantially cylindrical shape and defines central bore 21. Body section 12 of said first mandrel 10 is received within said central bore 21 of said disc spring assembly 20.

Key body member 40 has key housing 43, first external threads 42 and second external threads 45, as well as central through bore 41. At least one elongated slot(s) 44 is formed in said key housing and extend from the outer surface of said key housing to said central through bore 41. At least one elongated key member(s) 15 is received within said elongated slot(s) 44 of key housing 43 of key body member 40, with a portion of said elongated key member 15 residing within the said at least one elongated key slot(s) 14 of first mandrel 10. Substantially cylindrical key locking sleeve 30 has central through bore 32, at least one elongated key installation slot 31, and inner threads 33. Wear bushing 5 is received within central bore 41 of key body 40. Spacer ring 8 is received over thread 45 of key body member 40, as needed to change the final circumferentially indexed position of key insertion slot 31 of the key locking sleeve 30 so as the final position of key insertion slot 31 is not directly aligned with elongated slot(s) 44. Key housing 43, is received within central bore 33 of key locking sleeve 30, while internal threads 33 of key locking sleeve 30 engage with threads 45 of key body member 40.

Recoil housing 50, having a substantially cylindrical outer shape, has first end 53, second end 54 and central through bore 51 extending through said recoil housing 50 from said first end 53 to said second end 54. Transverse bores 57 extend from the outer surface to the central through bore 51 of said recoil housing 50. Threads 52 are disposed on the inner surface of said bore 51 of said recoil housing 50 near second end 54. Although not visible in FIG. 2, another set of threads are also disposed on the inner surface of said bore 51 of said recoil housing near first end 53, and are configured to engage and mate with threads 42 of key body member 40.

An elastomeric pressure sealing member 34 (which can be an O-ring or the like) can be received within central bore 51 of recoil housing 50. Body section 12 of said first mandrel 10 is at least partially received, and slidably disposed, within aligned bore 32 of key locking sleeve 30, bore 41 of key body member 40, and bore 51 of recoil housing 50. Wear bushing 5, spacer 8, and compression coil spring 25 are disposed within central bore 51 of recoil housing 50.

Second mandrel 60 generally comprises head member 61 and substantially cylindrical body section 62. Although not visible in FIG. 2, it is to be observed that head member 61 has internal threads that form a female or "box-end" threaded connection member having internal threads. Head member 61 of second mandrel 30 has a larger outer diameter than the inner diameter 26 of compression coil spring 25. Tapered groove 65 (having a smaller diameter than the outer diameter of body section 62) extends around the circumference of said body section 62 and is oriented substantially perpendicular to the longitudinal axis of said second mandrel 60. At least one port 66 is disposed at said tapered groove 65 and extends transversely through said body section 62 into a central bore 63 (not visible in FIG. 2).

Seal sleeve 70 has a central through bore 71 and at least one transverse port 77 extending though said sleeve 70.

Inner seals 72 and 73 are disposed within said bore 71; said seals 72 and 73 engage and form a fluid pressure seal against body member 62. Outer seals 74 and 75 are disposed on the outer surface of seal sleeve 70; said outer seals 74 engage against and form a fluid pressure seal against the inner surface of through bore 51 of recoil housing 50. Outer seals 75 engage against the inner surface of partial inner bore or barrel 84 of fluid diversion member 80 (not visible on FIG. 2) and form a fluid pressure seal between separate flow paths and chambers.

Body member 62 of second mandrel 60 is received within central bore 71 of seal sleeve 70, while second mandrel 60 (and seal sleeve 70) are disposed within central bore 51 of recoil housing 50. External threads 16 of first mandrel 10 engage with internal threads (not visible in FIG. 2) in head member 61, thereby resulting in said first mandrel 10 and second mandrel 60 being operationally attached in linear alignment, and providing a continuous flow path through first mandrel 10 and second mandrel 60 separate from the fluid area external to the first mandrel 10 and second mandrel 60.

Fluid diversion member 80 has bore 81 and external threads 82 and 83. Elastomeric pressure sealing members 89 (which can be O-rings or the like) are received within central bore 51 of recoil housing 50; said sealing members 89 engage against and form a fluid pressure seal against the inner surface of through bore 51 of recoil housing 50 and are positioned to specifically seal fluid communicated through transverse bore hole(s) 57 of recoil housing 50 from a portion of the remainder of through bore 51 of recoil housing 50. Threads 82 of fluid diversion member 80 engage and mate with threads 52 of recoil housing 50. Screen 7 can be installed using set screws 9.

Body section 12 of first mandrel 10 has an effectively constant outer diameter, as well as a length extending past inner seals 73 of seal sleeve 70 a predetermined distance at least equal to the tensile stroke available in the final assembly. Portions of said first mandrel 10 passing through other devices such as housings, guides, springs and bushings may be of a different diameter, but must not interfere with linear reciprocation of the apparatus or undesirably change the volume of any designated flow path(s) (especially during reciprocations).

Figure 3A:
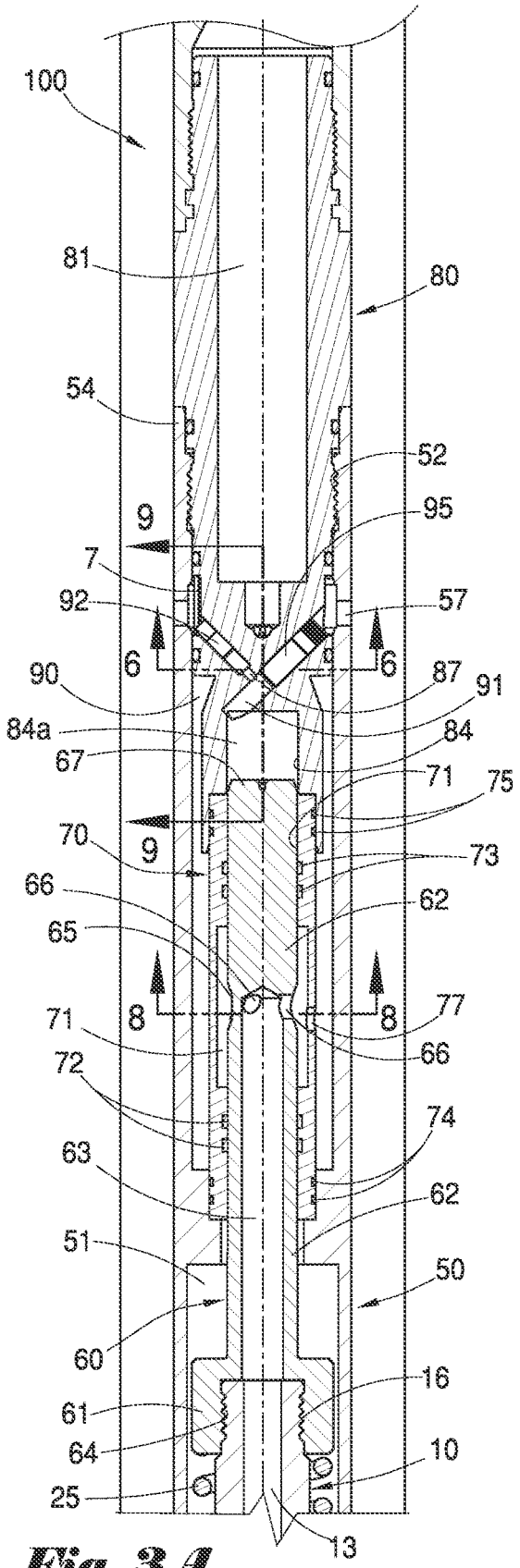
FIG. 3A depicts a side sectional view of a portion of the shock dampener apparatus of the present invention.
Figure 3B:
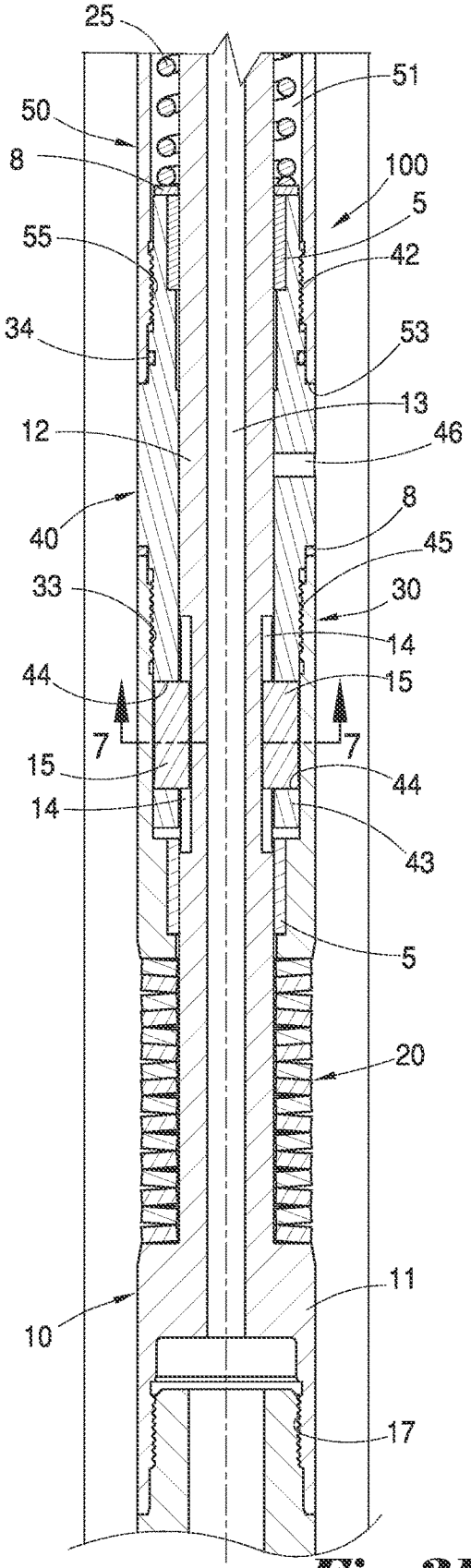
FIG. 3B depicts a side sectional view of a portion of the shock dampener apparatus of the present invention.

FIG. 3A depicts a side sectional view of a portion of shock dampener apparatus 100 of the present invention, while FIG. 3B depicts a side sectional view of a portion of said shock dampener apparatus 100. As depicted in FIGS. 3A and 3B, dampener 100 is in a substantially stationary or relaxed state—that is, not subject to significant compression or tensile loading that would cause physical displacement of dampener 100. Dampener 100 generally comprises substantially cylindrical first mandrel 10 and substantially cylindrical second mandrel 60; said first mandrel 10 and second mandrel 60 are aligned along their longitudinal axes and connected to each other, wherein said connection forms a fluid pressure seal. Said connected first mandrel 10 and second mandrel 60 cooperate to operationally function as a single central mandrel.

First mandrel 10 generally comprises head member 11 and substantially cylindrical body section 12. Central bore 13 extends though body section 12 and head member 11 having internal threads 17 that form a female or "box-end" threaded connection member. First mandrel 10 also has external threads 16 that form a male or "pin-end" threaded connection member. At least one elongated key slot(s) 14 extends along the outer surface of said body section 12 and is oriented parallel to the longitudinal axis of said body section 12 and bore 13.

At least one elongated key(s) 15 is slidably received within mating elongated slot(s) 44 formed in key housing 43 of key body member 40 and a portion of said elongated key(s) 15 is received with in the at least one elongated key slot 14 of first mandrel 10, while key housing 43 is, in turn, received within central bore 33 of key locking sleeve 30. Internal threads 33 of key locking sleeve 30 engage with threads 45 of key body member 40. A plurality of disc springs are oriented in a combined series/parallel stacking arrangement to form disc spring assembly 20 that is disposed around a portion of body section 12 of said first mandrel 10.

Recoil housing 50 has first end 53, second end 54 and central through bore 51 extending through said recoil housing 50 from said first end 53 to said second end 54. Threads 52 are disposed on the inner surface of said bore 51 of said recoil housing 50 near second end 54 and are configured to mate with threads 82 of fluid diversion member 80. Similarly, threads 55 are also disposed on the inner surface of said bore 51 of said recoil housing 50 near first end 53 and are configured to engage and mate with threads 42 of key body member 40.

Second mandrel 60 generally comprises head member 61 and substantially cylindrical body section 62 having central inner bore 63 extending along a portion of the length of said second mandrel 60. At least one transverse port 66 extends from inner bore 63 to the external surface of said second mandrel 60. Said head member 61 has internal threads 64 that mate with external threads 16 of first mandrel 10. Body member 62 of second mandrel 60 is received within central bore 71 of seal sleeve 70, while second mandrel 60 (and seal sleeve 70) are disposed within central bore 51 of recoil housing 50. Compression coil spring 25 is disposed within central bore 51 of recoil housing 50 between head 61 of second mandrel 60 and key body member 40.

Body section 12 of first mandrel 10 has a substantially constant outer diameter, as well as a length extending a predetermined distance past seals 73 at least equal to the tensile stroke described herein. Portions of said first mandrel 10 that are movably received within other devices (such as, for example, housings, guides, springs and bushings) may be of a different diameter, but should not interfere with linear reciprocation of the apparatus or undesirably change the volume of any designated fluid flow path(s), especially during reciprocations of dampener 100.

In a preferred embodiment, second mandrel 60 has tapered circumferential groove 65 along its outside diameter intersecting port(s) 66 in order to facilitate the safe compression and passage of seal members inside inner bore 71 of seal sleeve 70, particularly during assembly. Elastomeric sealing members 72 and 73 engage against the outer surface 62 of said second mandrel 60 to form a fluid pressure seal, including during relative dynamic movement between said mandrel 60 and seals 72 and 73. Furthermore, seals 72 and 73 will each remain engaged on outer surface 62 on each side of said circumferential groove 65 during all designed operational movements of dampener 100 (typically extension or retraction along the longitudinal axis).

Said second mandrel 60 is beneficially of sufficient length to allow said tapered groove 65 to remain positioned between spaced-apart inner seal members 72 and 73 during the course of dampener reciprocations to maximum allowable stroke in either direction. Thus, said fluid pressure seals are maintained, and the total volume of the space formed between the outer surface of said second mandrel 60 and the inner surface of said seal sleeve 70 is preserved, regardless of the relative position of the said second mandrel 60 within said seal sleeve during dampener reciprocations.

The inside diameter of bore 71 of seal sleeve 70 includes grooves for receiving seal members 72 and 73; in a preferred embodiment, said grooves are oriented parallel to each other and are redundant. Elastomeric seals 72 and 73 (which can be O-rings, chevron seals or other configuration) are of a selected type suitable for the application, sufficiently dimensioned, made of appropriate materials, of sufficient durometer, and oriented to seal all differential pressures to or from isolated flow path(s) while second mandrel 60 reciprocates along its design length. The ideal seal type, material, durometer, and orientation may vary significantly with fluid properties and easily determined by any person skilled in the art of dynamic fluid sealing methods.

Inside diameter of bore 71 of seal sleeve 70 is designed so that its inner surface located between grooves for receiving seals members 72 and 73 is sufficiently larger than the associated outside diameter of body 62 of second mandrel 60 so as to create a flow area sufficient to accommodate passage of fluid conveyed through said flow path without exceeding a predetermined maximum fluid velocity. Seal sleeve 70 further comprises seal members 74 and 75 on the outer surface of seal sleeve 70; outer seal members 74 engage against and form a fluid pressure seal with the inner surface of central bore 51 of recoil housing 50, while outer seal members 75 engage against and form a fluid pressure seal against the inner surface of bore 84 of fluid diversion member 80. Said seal members 74 and 75 are designed to seal anticipated differential fluid pressures at each intersecting feature on associated components in order to prevent communication of fluid conveyed in an isolated fluid flow path to all other isolated flow paths and chambers.

Seal sleeve 70 further comprises at least one port 77 extending from the outer surface of seal sleeve 70 to inner bore 71. Said at least one port 77 permits communication of fluid in any direction between said inner bore 71 and the annular space 90 formed between the outer surface of seal sleeve 70 and the inner surface of bore 51 of recoil housing 50; and said at least one port 77 is longitudinally located between seals 72 and seals 73 of seal sleeve 70.

Fluid diversion member 80 has first central bore 81, and second central bore or barrel 84 defining an inner chamber 84*a*. Inner chamber 84*a* is designed to provide sufficient dimension to allow substantially unrestricted motion of distal end 67 of second mandrel 60 for a desired distance (typically, at least the length of available dampener compressive stroke). Fluid diversion housing 80 also rigidly connects, in a fluid pressure sealed manner, to recoil housing 50.

First mandrel 10 has at least one elongated groove(s) or key slot(s) 14 formed in the outer surface of said first mandrel. Said key slot(s) 14 is of sufficient depth, width, and length to (each) accommodate a key 15 having a slightly narrower width, and sufficient length and height, to reliably transfer torque forces applied from said first mandrel 10 to each of said key(s) 15 and key body member 40. Said key slot(s) 14 extend at least along the length of the maximum compressive and extension strokes beyond the respective end of each key(s) 15. Said key(s) 15 is retained within key slot(s) 14 primarily by the inside surface of key locking sleeve 30.

Key body member 40 is formed with at least one key slot(s) 44 aligned to receive said key(s) 15, and dimensioned to fit the portion of key(s) 15 protruding radially outward into said key slot(s) 44. In a preferred embodiment, the outside diameter of key body member 40 approximates the diameter of two keys, installed in the shaft approximately 180 degrees opposing. Key body member 40 is rigidly fastened to recoil housing 50 on one end and is rigidly fastened to key locking sleeve 30 on the opposite end. Key locking sleeve 30 distal end opposite of the end fastened to key body member 40 is further configured to act as a shoulder surface for compressing of disc spring assembly 20. Similarly, head 11 of first mandrel 10 has a sufficient diameter and is configured to act as an opposing shoulder for compressing said disc spring assembly 20.

In a preferred embodiment, an annular space 90 is formed between fluid diversion member 80 and recoil housing 50 that permits fluid flow, in any direction, within a dedicated fluid flow path. At least one primary flow channel 85 (not visible in FIG. 3A, but depicted in FIGS. 6, 8 and 9) extends from annular space 90 to central bore 81 of fluid diversion member 80; said primary flow channel(s) 85 allows for bidirectional communication of fluid and permit sufficient combined flow area to prevent fluid velocity from exceeding a predetermined maximum for a specific application. Although other configurations can be envisioned, said flow channel(s) 85 is directed at an acute (typically 45 degree) angle from the central longitudinal axis of central bore 81.

At least one secondary flow channel 91 is oriented approximately 90-degrees phased from said primary flow channel(s). Secondary flow channel 91 is designed to accommodate a self-captivated, inline, spring loaded poppet style check valve 95 that is oriented to allow relatively unrestricted flow of fluid through said secondary flow channel 91 from inner chamber 84*a* through traverse bore 57 of recoil housing 50 to the flow channel surrounding dampener 100. In this embodiment, the self-captivated, inline, spring loaded poppet style check valve 95 is further oriented to prevent flow into chamber 84*a* through secondary flow channel 91 from the flow channel surrounding dampener 100 through traverse bore 57 of recoil housing 50. This orientation effectively allows relatively unrestricted effluent discharge of chamber 84*a* to the flow channel surrounding dampener 100 without allowing reverse flow from said flow channel surrounding dampener 100 back into chamber 84*a* of diversion member 80.

Fluid diversion housing 80 has at least one tertiary flow channel 87 extending through said housing. Said at least one tertiary flow channel 87 is oriented approximately 180 degrees phased from secondary flow channel 91, and has geometry designed to accommodate a flow control orifice(s) 92 dimensioned to regulate flow into chamber 84*a* from the flow channel surrounding dampener 100 through traverse bore 57 of recoil housing 50, thus regulating the speed at which dampener 100 can extend due to energy stored in disc spring assembly 20 during a compressive event (or when a tensile strain is applied to a connected device with dampener 100 in a static state). Orifice 92 also provides a restricted parallel flow path out of first chamber 84*a* during compressive motions of dampener 100.

Because the maximum amount of energy stored in a spring can be determined for a designed maximum stroke, it is possible to determine in advance a maximum extension force generated by recovery of the spring assembly 20 and, thus, the potential maximum pressure differential between said first chamber 84*a* and the flow channel surrounding dampener 100 can also be predicted for given design dimensions. As a result, at least one orifice 92 having desired dimensions can be selected for a given set of fluid properties to suppress recoil motion of dampener 100 in a specific application.

Additional features and items are included to extend the life, increase the functional reliability, and to facilitate the economical servicing of this embodiment such as, for example, wear bushings 5 to provide radial support. At least one vent port can be disposed in at least one location along the length of recoil housing 50 (typically in the vicinity of the compression spring 25) to prevent trapping pressure. Similarly, optional shims or spacers 8 are dimensioned to a specific thickness to allow effectively a 45-degree change in relative indexing of key insertion slot(s) 31. At least one optional port may be included to inject grease or other lubricating fluids in said key body member 40. At least one optional screen 7 having a desired mesh size can be installed.

Figure 6:
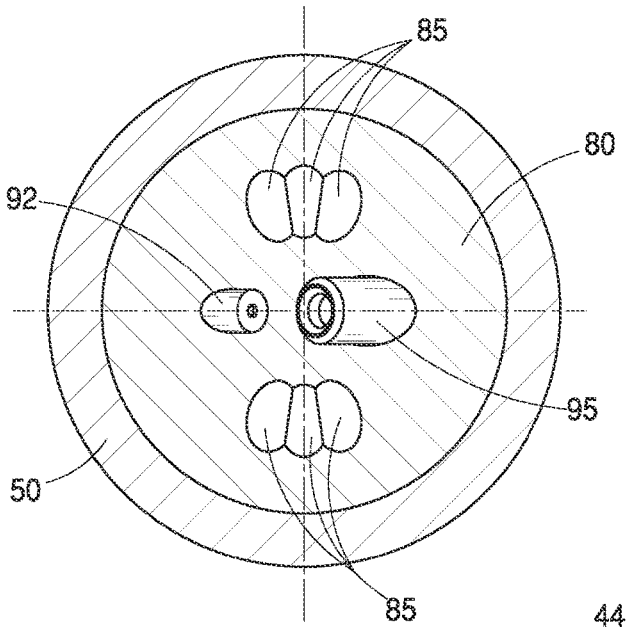
FIG. 6 depicts a sectional view along line 6-6 depicted in FIG. 3A.

FIG. 6 depicts a sectional view along line 6-6 depicted in FIG. 3A, generally across fluid diversion member 80 and recoil housing 50. At least one primary flow channel 85 extends through fluid diversion member 80 allowing communication of fluid in both directions between bore 81 (not visible in FIG. 6) and annular space 90 (not visible in FIG. 6) and is of sufficient combined flow area to prevent fluid velocity from exceeding a predetermined maximum for the specific application. Although other configurations can be envisioned, said primary flow channel(s) 85 is directed at an acute (typically 45 degree) angle from the central longitudinal axis of central bore 81 and extends outward to annular space 90.

Secondary flow channel 91 is oriented approximately 90-degrees phased from said primary flow channel(s) 85. Secondary flow channel 91 is designed to accommodate a self-captivated, inline, spring loaded poppet style check valve 95 that is oriented to allow relatively unrestricted flow of fluid out of chamber 84*a* through said secondary flow channel 91. At least one tertiary flow channel 87 is oriented approximately 180 degrees phased from secondary flow channel 91, and has geometry designed to accommodate a flow control orifice(s) 92 dimensioned to regulate flow into chamber 84*a* at a controlled rate.

Figure 7:
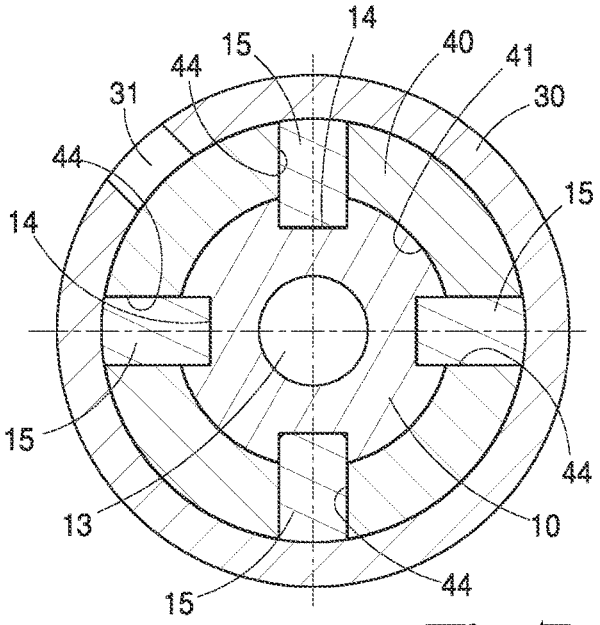
FIG. 7 depicts a sectional view along line 7-7 depicted in FIG. 3B.

FIG. 7 depicts a sectional view along line 7-7 depicted in FIG. 3B, generally across key locking sleeve 30, key housing 43, and first mandrel 10. First mandrel 10 has at least one elongated groove(s) or key slot(s) 14 formed in the outer surface of said first mandrel 10. At least one key(s) 15 is retained partially within said key slot(s) 14 primarily by the inside surface of key locking sleeve 30. Key(s) 15 and the associated components permit the transfer of torque forces through dampener 100 of the present invention. Put another way, torque forces applied to a first end of dampener 100 (and any connected device) are transferred through said dampener 100 to a second end of dampener 100 (and any connected device) primarily by means of key(s) 15 contact with key slot(s) 14 of mandrel 10 and key slot(s) 44 of key body 40.

Fluid flow paths communicate both externally around dampener 100, as well as internally through dampener 100, permitting fluid communication with at least one connected device(s) above and/or below said dampener 100; in most applications, at least one ancillary device is connected above and below said dampener 100. Said at least one connected device(s) can be rigidly attached to said dampener 100 with any fluid flow passing from said connected device to dampener 100 via said internal flow path, while preserving its original relative pressure, volume, and the volumetric flowrate during all designed operational movements of dampener 100. Said dampener 100 internal flow paths are primarily defined by bore 81, flow channel(s) 85, annular space 90, port(s) 77, port(s) 66, bore 63, and bore 13.

By way of illustration, but not limitation, fluid (such as drilling mud or other desired fluid) can be pumped from the surface of a wellbore, through a tubular workstring as well as any optional equipment, to dampener 100. In the orientation depicted in FIGS. 3A and 3B, fluid can flow through bore 81, flow channel(s) 85 (best depicted in FIGS. 6, 8 and 9), into annular space 90, through port(s) 77 in seal sleeve 70 and port(s) 66 in second mandrel 60, and into bore 63 of said second mandrel 60. Said fluid can then flow through aligned central bore 13 of first mandrel 10 and, ultimately, into any optional equipment or device attached to said first mandrel 10. In this manner, fluid is free to flow without any substantial flow restriction through dampener 100 of the present invention while preserving its fluid volume, fluid pressure and flow rate regardless of the operational state (such as compressed or extended) of dampener 100.

At least one auxiliary flow path, not shown in this embodiment, can also exist from chamber 84*a* to further facilitate additional fluid communication to accomplish other supplemental tasks; by way of illustration, but not limitation, said supplemental tasks can include without limitation: activating a hydraulic latching mechanism, signaling alerting functions, monitoring or logging pressure fluctuations, providing a feedback signal to adjust the apparatus' resistance to motion through some other developed means, or any other task that can be accomplished using diverted fluid flow.

Encountered shock energy along the longitudinal axis of dampener 100 of the present invention is absorbed/stored through a means of springs, elastomers, electro resistive devices, hydraulics, and/or other similar means as more fully described herein. Further, such energy is subsequently released in a controlled and regulated manner through fluid segregation features and flow control features of said dampener 100.

Further, in operation, dampener 100 of the present invention is capable of hydraulically suppressing motion, in one or both linear directions along the longitudinal axis of dampener 100, also without altering the average relative pressure, volume, or volumetric flowrate of fluid contained in said internal fluid flow path(s) primarily defined by bore 81, flow channel(s) 85, annular space 90, port(s) 77, port(s) 66, bore 63, and bore 13. Said hydraulically suppressed motion acts to regulate the speed at which a given force will extend (or compress if so configured) said dampener regardless of whether said force is generated by external dynamics, or results from recoil forces from released energy stored by said dampener. Conservation of relative pressure, volume and volumetric fluid flowrate of said internal flow path is accomplished by employing a dedicated chamber (chamber 84*a* in this embodiment) that can contain a fluid that will readily evacuate to a particular designated external fluid flow path when dampener 100 is compressed. Alternatively, said chamber will be filled in a regulated manner (from a designated fluid flow path) when said dampener 100 extends, without influencing the average relative pressure, volume, or volumetric flowrate of the fluid contained in a separate said internal fluid flow path through dampener 100.

Regulation of fluid flow in and out of said chamber is achieved by using at least one "one way" valve(s) (such as a check valve or flapper valve) and/or at least one fluid flow control orifice(s). Said at least one check valve allows relatively unrestricted fluid flow to alternatively evacuate (or fill, if so configured) said dedicated chamber. Further, said orifice(s) is so dimensioned as to regulate the flow rate of fluid filling (or evacuating. if so configured) said chamber, thus hydraulically suppressing motion in one or both linear directions. Said at least one orifice(s) may alternatively comprise a variable flow valve, such as a needle valve, that may be regulated either manually, or automatically using fluid displaced from said chamber or other controlling means.

Redirection of fluid to and from said chamber can further be utilized to accomplish other supplemental tasks; such tasks can include, without limitation, activating a hydraulic latching mechanism, regulating said alternative variable flow valve, signaling alerting functions, monitoring or logging pressure fluctuations, providing a feedback signal to adjust the apparatus' resistance to motion, or other means by which such diverted fluid may be used.

In a preferred embodiment, dampener 100 is configured to rapidly absorb asymmetrical shock events where the peak events create a compressive force on the dampener (bottom mount type MWD) and tensile events (typically due to the recoil of a compressive event) are of lower magnitude and absorbed primarily through regulation of fluid flow into chamber 84*a*. Multiple iterations of this described preferred embodiment where various seals' placements are modified to create a "male gland" in lieu of a "female gland", or vice versa, are all possible in a multitude of different combinations. Additionally, other embodiments may reverse the designed longitudinal vector dampener 100 is intended to absorb as described later herein.

Hydraulically unrestricted effluent flowing to said external flow path allows spring compression resistance to dominate forces resisting compressive motion of dampener 100, thus allowing spring resistance to be pre-selected based upon the mass of the device (and attached components) and the anticipated magnitude/duration of targeted shock events, and thus maximizing potential effectiveness of dampener 100. In this embodiment, the desired compressive force and stroke are achieved using disc springs in a combined series/parallel stacking arrangement (depicted in the appended drawings as spring assembly 20).

Figure 8:
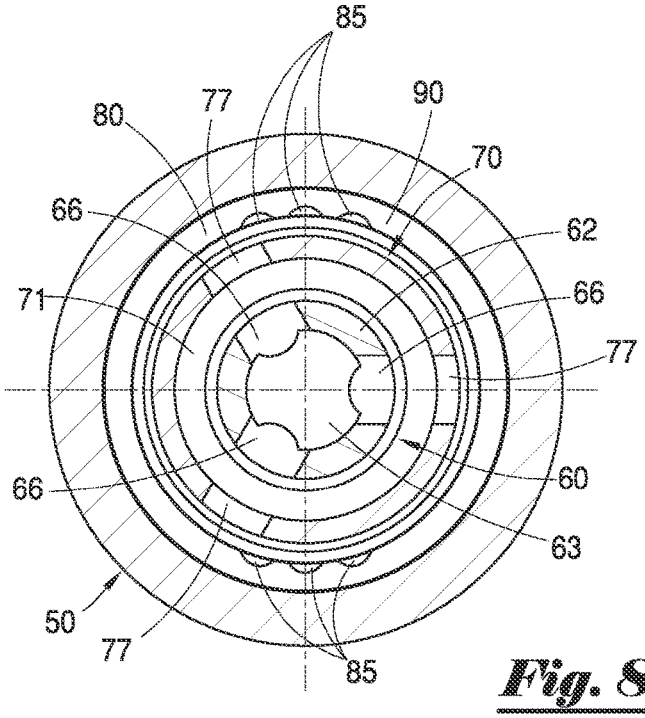
FIG. 8 depicts a sectional view along line 8-8 depicted in FIG. 3A.

FIG. 8 depicts a sectional view along line 8-8 depicted in FIG. 3A, generally across second mandrel 60 and seal sleeve 70. As depicted in FIG. 8, second mandrel 60 having central bore 63 and transverse port(s) 66, is disposed within bore 71 of seal sleeve 70. Transverse bore(s) 77 extends through seal sleeve 70. Annular space 90 is formed between the outer surfaces of both said seal sleeve 70 and outer surface of the smaller diameter end of diversion body 80; and the inner surface of recoil housing 50. Flow channel(s) 85 opens into said annular space 90.

Figure 9:
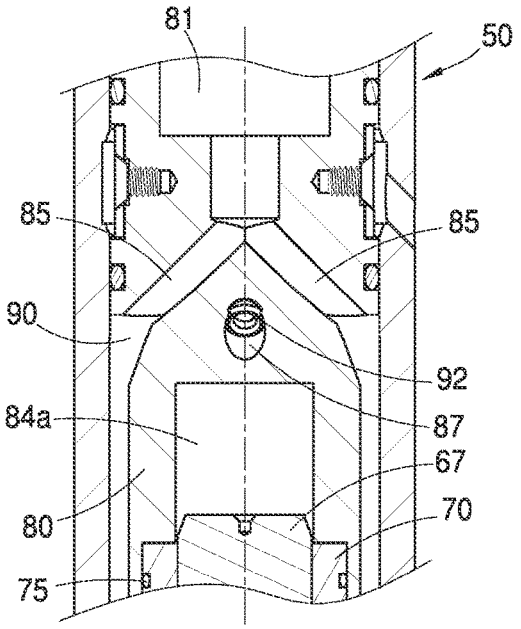
FIG. 9 depicts a sectional view along line 9-9 depicted in FIG. 3A.

FIG. 9 depicts a sectional view of dampener 100 along line 9-9 depicted in FIG. 3A. Flow channel(s) 85 extends through fluid diversion member 80 and allow for fluid flow communication between annular space 90 and bore 81 of said fluid diversion member 80. It is to be observed that said annular space 90, flow channel(s) 85 and bore 81 are isolated from (that is, not in fluid communication with) chamber 84*a* that is formed by barrel 84 and cooperating distal end 67 of second mandrel 60.

Figure 4A:
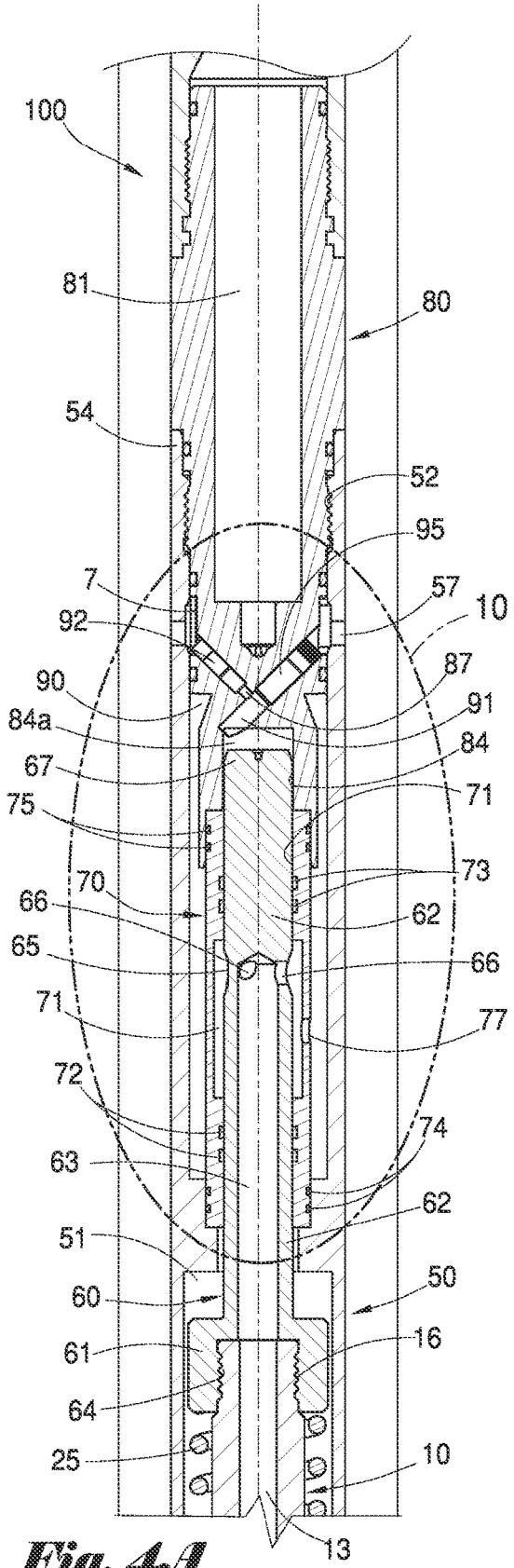
FIG. 4A depicts a side sectional view of a portion of the shock dampener apparatus of the present invention in a substantially compressed state.
Figure 10:
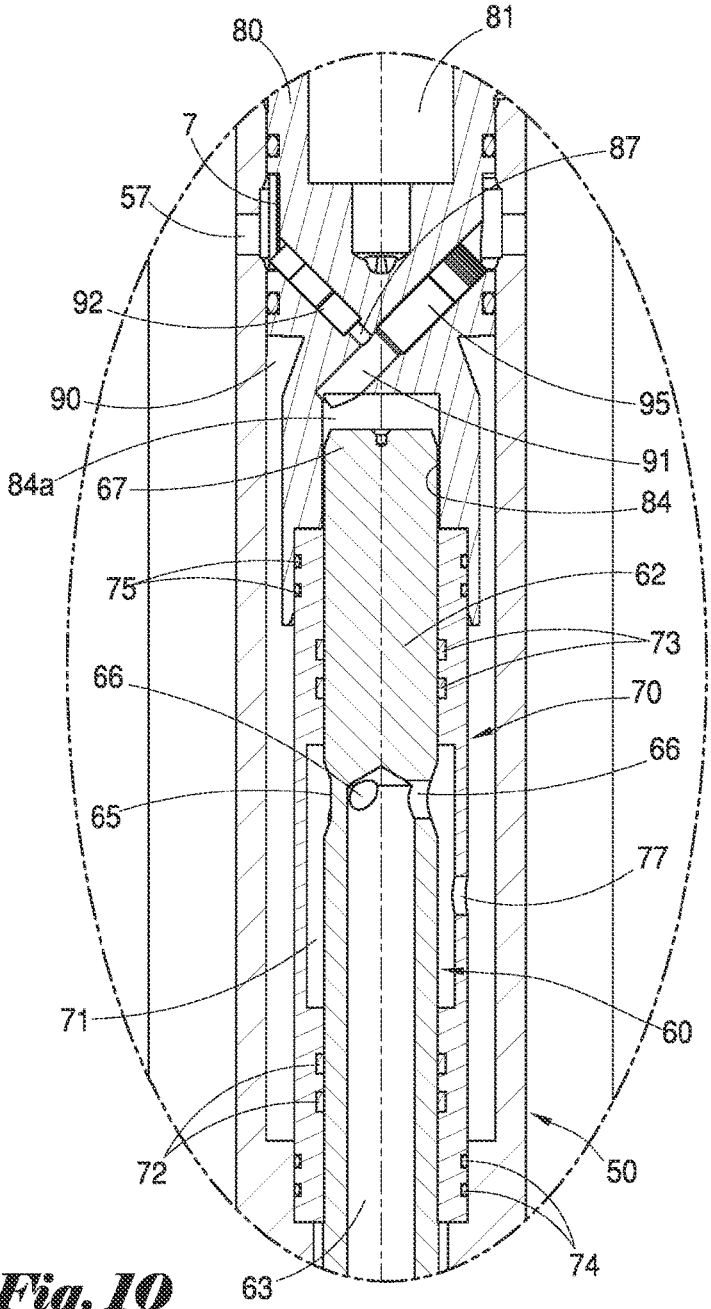
FIG. 10 depicts a detailed view of the highlighted section depicted in FIG. 4A.

FIG. 10 depicts a detailed view of the highlighted section of dampener 100 depicted in FIG. 4A (dampener 100 in a substantially compressed state). Screen 7 can be installed directly upstream of orifice 92. The inner flow path (primarily defined by bore 81, flow channel(s) 85 (not visible in FIG. 10), annular space 90, port(s) 77, port(s) 66, bore 63, and bore 13, not visible in FIG. 10) from a connected first device to a connected second device (or vice versa) is completed through dampener 100 while preserving the original pressure, volume, and volumetric flowrate of the fluid inside said inner flow path during any axial motion (extension or compression) of the dampener 100.

Figure 4B:
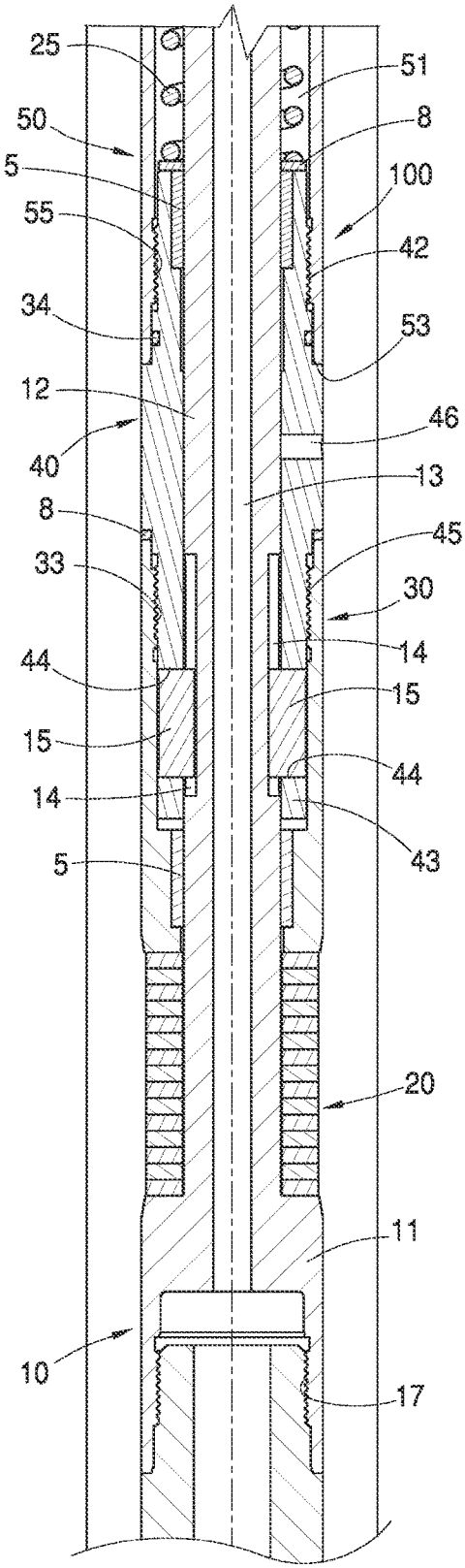
FIG. 4B depicts a side sectional view of a portion of the shock dampener apparatus of the present invention in a substantially compressed state.

FIG. 4A depicts a side sectional view of a portion of shock dampener apparatus 100 of the present invention in a substantially compressed state, while FIG. 4B depicts a side sectional view of a portion of said shock dampener apparatus 100 in said substantially compressed state. The configurations depicted in FIGS. 4A and 4B reflect operation of dampener 100 in connection with absorbed shock events compressing dampener 100 and the resulting extension of dampener 100 hydraulically suppressing recoil energy stored during said initial shock event.

FIGS. 4A and 4B depict a compressive load applied along the longitudinal axis of dampener 100 (and connected devices). Such a load may be due to many causes, but is frequently inertial in nature caused by the combined mass of a connected device(s). Referring to FIGS. 4A, 4B and 10, as load is applied during a compressive event, force is transferred from an upper connected device to a lower connected device through dampener 100 and compression of spring 20. As spring 20 compresses, distal end 67 of second mandrel 60 is relatively displaced into internal chamber 84*a* formed by barrel 84. As the volume of said chamber 84*a* decreases, fluid is displaced from said chamber 84*a* and passes through secondary flow channel 91, through a relatively low resistance check valve 95 with a small percentage of flow also displacing through a parallel flow path restricted by orifice(s) 92. The entirety of this displaced fluid is transferred to the flow channel external to the dampener 100 (typically an annular space formed between the exterior surface of dampener 100 and the inner surface of a surrounding pipe or wellbore) via port 57 of recoil housing 50.

As said compressive event concludes, or the motion limit of dampener 100 is reached, fluid no longer flows out of said chamber 84*a*, and energy stored in said disc spring assembly 20 can be released. Energy stored in said spring 20 generates a force approximately equal to and opposite of the force causing the compression and will cause dampener 100 to begin to extend from its compressed state. This extension results in the relative retraction of said second mandrel 60 within barrel 84, thereby increasing the volume of said chamber 84*a* and resulting in a relatively lower fluid pressure in said chamber 84*a* that accumulates until a force balance between the compressed spring assembly 20 applied force and differential pressure force acting on the sealed area of chamber 84*a* is reached. This reduction in fluid pressure causes effluent check valve 95 to close, while fluid flow enters said chamber 84*a* from the flow channel external to dampener 100 (again, typically an annular space formed between the exterior surface of dampener 100 and the inner surface of a surrounding pipe or wellbore) through port 57 of recoil housing 50 via flow control orifice(s) 92 and flow channel 87. It is to be observed that said flow control orifice 92 can be adjusted in advance to satisfy anticipated conditions for a desired application.

As fluid is regulated into chamber 84*a*, absolute pressure within chamber 84*a* increases, disrupting said force balance, allowing the force of compressed spring assembly 20 to partially decompress (expand) dampener 100 and further retract second mandrel 60 from chamber 84*a*; retraction of second mandrel 60 increases volume of chamber 84*a* which, in turn, reduces fluid pressure in chamber 84*a*. As fluid continues to be regulated into chamber 84*a*, this process continues to regulate the rate at which second mandrel 60 can retract from barrel 84, and thus the rate at which dampener 100 can decompress spring assembly 20 after absorbing a said shock event, continuing until stroke limits of dampener 100 is reached, effectively fully regulating dampener 100 expanding recoil through the hydraulic suppression method described herein.

Differential pressure values can be significant and typically should be considered when calculating desired recoil speeds. Fluid properties (such as, for example, phase conversion from liquid to gas) should also be considered. Additionally, a variable to be considered is the volume of air/gas entrained within fluid contained in the chamber 84*a*. Any entrained air/gas will typically expand as absolute pressure decreases within said chamber 84*a*. As this said entrained air/gas expands in accordance with Boyles Law, it will alter recoil suppression performance.

Throughout the course of dampener 100 compressing and extending to its stroke limits, the average relative pressure, volume, and volumetric fluid flowrate contained within the internal flow path through dampener 100 (as generally defined by bore 81, flow channel 85, annular space 90, port(s) 77, port (s) 66, bore 63, and bore 13) is not influenced or altered by the change in length of dampener 100. This, in turn, prevents sending of inadvertent hydraulic signals to connected devices, thereby reducing hydraulic shock on components connected to the said internal flow path, and ultimately conserving the hydraulic state of devices connected to dampener 100 via said internal flow path. Additionally, as pressure changes occur through said internal flow path as a result of functions of connected devices, dampener 100 will not extend or compress as differential pressures accumulate between said internal flow path and the external flow path around dampener 100 (typically an annular space formed between the exterior surface of dampener 100 and the inner surface of a surrounding pipe or wellbore), preserving the relative position of dampener 100, preserving preload on energy storage devices (spring assembly 20 and compression spring 25), and thus preserving the performance characteristics of dampener 100 when responding to a given shock or impact event.

Additionally, another flow path not illustrated in this embodiment, can be hydraulically connected to an ancillary device (such as a piston with bleed down orifice connected to a latching mechanism) not illustrated in this embodiment with the volume of the said ancillary device sufficient to accommodate some portion of the fluid displaced from chamber 84*a*, and the said ancillary device having a piston stroke designed to accommodate a specific function before a predetermined portion or percentage of the available volume from chamber 84*a* is transferred.

In such an event, fluid displaced from chamber 84*a* via a non-illustrated flow path fills an ancillary device chamber on one side of said sealed piston in said ancillary device, forcing said piston to overcome a predefined spring resistance, and stroking the piston with a connected latch into an engaged position with a connected device not illustrated in this embodiment. As this region on the actuation side of the said piston is being filled, any accumulated differential pressure is allowed to vent through the ancillary device's bleed down orifice, sized so as to allow venting at a sufficiently slow rate as to not preclude actuation of the ancillary function with a designated stroke approximately equivalent to the volume of the second mandrel 60 moving into chamber 84*a* over a determined timeframe.

As said compressive event concludes, or the motion limit of dampener 100 is reached, fluid no longer flows out of said chamber 84*a*, and energy stored in dampener 100 disc spring assembly 20 can be released. As energy stored in spring assembly 20 is released as described in herein, the said ancillary device piston spring acts to return said ancillary device piston, allowing flow through said bleed down orifice, while disengaging said latching mechanism.

Throughout the course of dampener 100 compressing and extending to its stroke limits, and while actuating and releasing said ancillary device (piston with bleed down orifice and latching mechanism) the average relative pressure, volume, and volumetric fluid flowrate contained within the internal flow path through dampener 100 (as generally defined by bore 81, flow channel 85, annular space 90, port(s) 77, port(s) 66, bore 63, and bore 13) is not influenced or altered by the change in length of dampener 100. This, in turn, prevents sending of inadvertent hydraulic signals to connected devices, thereby reducing hydraulic shock on components connected to the said internal flow path, and ultimately conserving the hydraulic state of devices connected to dampener 100 via said internal flow path. Additionally, as pressure changes occur through said internal flow path as a result of functions of connected devices, dampener 100 will not extend or compress as differential pressures accumulate between said internal flow path and the external flow path around dampener 100 (typically an annular space formed between the exterior surface of dampener 100 and the inner surface of a surrounding pipe or wellbore), preserving the relative position of dampener 100, preserving preload on energy storage devices (spring assembly 20 and compression spring 25), and thus preserving the performance characteristics of dampener 100 when responding to a given shock or impact event.

In an alternative MWD configuration, commonly referred to as a "top mount" configuration, an MWD is effectively suspended with in a drill pipe (typically referred to as a non-magnetic drill collar) and drilling dynamics are such that most peak shock events create a tensile load on dampener 100 due to the suspended mass of the MWD tool below. In this application, dampener 100 would still be placed between the said Pulser and said Mud Valve, yet it will be configured to primarily absorb shock energy during extension of dampener 100 and hydraulically suppress recoil during the subsequent retraction of dampener 100. For a "top mount" MWD, spring selections will be made to accommodate higher energy absorption potential on a tensile event and a lower potential energy absorption on a compressive (recoil). In such cases, placement of the spring types can be reversed from the configuration depicted herein, and resized as appropriate. For the ease of illustration, this "top mount" configuration appears the same as the "bottom mount" configuration illustrated in FIGS. 1, 2, 3*a*, 3*b*, 4*a*, and 4*b*.

In such cases, fluid flow regulation into and out of internal chamber 84*a* would be inverse, where it would be desirable to allow relatively unrestricted flow into said chamber 84*a* which would allow the tensile event spring's compression resistance to dominate forces resisting tensile motion of dampener 100, thus allowing spring resistance to be selected based off the mass of a first connected device (and attached components) and the anticipated magnitude/duration of targeted axial shock events. To achieve this, an inline check valve should be capable of allowing relatively unrestricted influent flow while stopping effluent flow from said chamber 84*a*. Care should be taken to ensure the captivating features and sealing features of the selected check valve 95 and orifice(s) 92 would be sufficient to withstand the anticipated internal pressure accumulation in chamber 84*a* during recoil motion of dampener 100 configured in this manner. Any captivation method modification is easily made by someone skilled in the art.

Figure 5A:
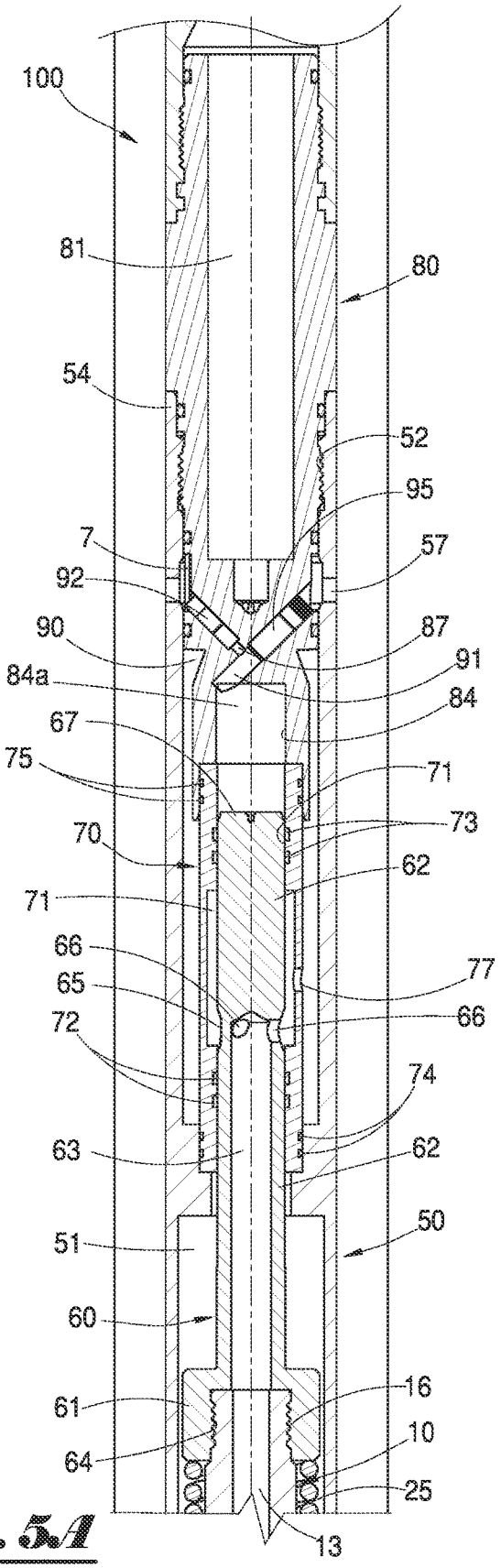
FIG. 5A depicts a side sectional view of a portion of the shock dampener apparatus of the present invention in a substantially extended state.
Figure 5B:
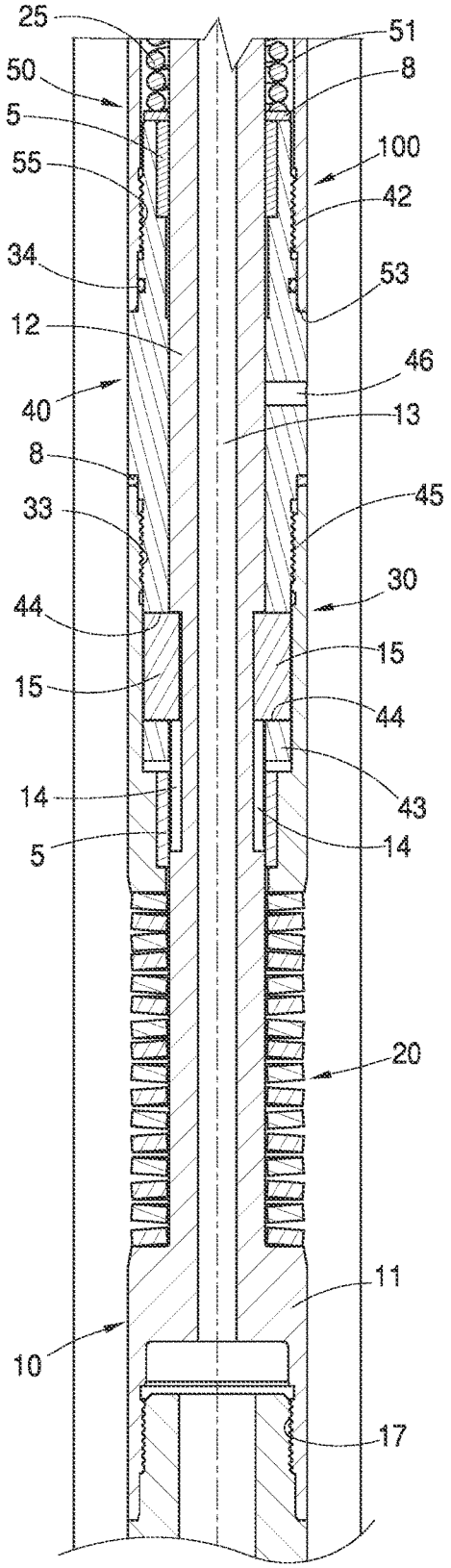
FIG. 5B depicts a side sectional view of a portion of the shock dampener apparatus of the present invention in a substantially extended state.

FIG. 5A depicts a side sectional view of a portion of shock dampener apparatus 100 of the present invention in a substantially extended state, while FIG. 5B depicts a side sectional view of a portion of said dampener apparatus 100 of the present invention in a substantially extended state. The configurations depicted in FIGS. 5A and 5B reflect operation of dampener 100 in connection with operating with a suspended mass below dampener 100, resulting in peak shock events creating a tensile load on dampener 100 and recoil events being hydraulically suppressed during dampener 100 contraction.

FIGS. 5A and 5B depict a tensile load applied along the longitudinal axis of dampener 100 (and connected devices). This load may be due to many causes, but is assumed to be inertial in nature caused by a shock event on a top mounted MWD system, thus extension of dampener 100 is being used to absorb the shock event in lieu of the previously described compression of dampener 100 absorbing shock energy. As tensile load is transferred from a lower connected device to an upper connected device through dampener 100, compression of spring 25 occurs, and second mandrel 60 retracts relative to barrel 84, thereby increasing the volume of said chamber 84*a*. The void within said chamber 84*a* is filled by fluid passing from the flow channel external of dampener 100 (typically an annular space formed between the exterior surface of dampener 100 and the inner surface of a surrounding pipe or wellbore) through port 57, a relatively low resistance check valve 95 and flow channel 91 with a small amount of fluid flow displacing through a parallel flow path 87 restricted by flow control orifice 92.

As the tensile event concludes, or the motion limit of the dampener 100 is reached, fluid no longer flows into said chamber 84*a*, and energy stored in said spring is available to be released. Energy stored in said spring 20 generates a force approximately equal to and opposite of the force causing the extension and will cause dampener 100 to begin to contract from its extended state. This contraction results in the relative insertion of said second mandrel 60 into barrel 84, thereby decreasing the volume of said chamber 84*a* and resulting in a relatively higher fluid pressure in said chamber 84*a* that accumulates until a force balance between the compressed spring 25 applied force and the differential pressure force acting on the sealed area of chamber 84*a* is reached. This increase in relative fluid pressure causes check valve 95 to close, while fluid exits chamber 84*a* to the flow channel external to dampener 100 (again, typically an annular space formed between the exterior surface of dampener 100 and the inner surface of a surrounding pipe or wellbore) through port 57 of recoil housing 50 via flow control orifice(s) 92 and flow channel 87. It is to be observed that said flow control orifice 92 can be adjusted in advance to satisfy anticipated conditions for a desired application.

As fluid is regulated out of chamber 84*a*, absolute pressure within chamber 84*a* decreases, disrupting said force balance, allowing the force of compressed spring 25 to partially extend, contracting dampener 100 and further inserting second mandrel 60 into chamber 84*a*, again decreasing volume and again increasing pressure in chamber 84*a*. As fluid continues to be regulated out of chamber 84*a*, this process continues to regulate the rate at which second mandrel 60 can insert into barrel 84, and thus the rate at which dampener 100 can decompress spring 25 after absorbing a said shock event, continuing until stroke limits of dampener 100 is reached, effectively fully regulating dampener 100 recoil contraction through the hydraulic suppression method described herein.

Throughout the course of dampener 100 extending and compressing to its stroke limits, the average relative pressure, volume, and volumetric fluid flowrate contained within the internal flow path through dampener 100 (as generally defined by bore 81, flow channel 85, annular space 90, port(s) 77, port(s) 66, bore 63, and bore 13) is not influenced or altered by the change in length of dampener 100. This, in turn, prevents sending of inadvertent hydraulic signals to connected devices, thereby reducing hydraulic shock on components connected to the said internal flow path, and ultimately conserving the hydraulic state of devices connected to dampener 100 via said internal flow path. Additionally, as pressure changes occur through said internal flow path (as generally defined by bore 81, flow channel 85, annular space 90, port(s) 77, port(s) 66, bore 63, and bore 13) as a result of functions of connected devices, dampener 100 will not extend or compress as differential pressures accumulate between said internal flow path and the external flow path around dampener 100 (typically an annular space formed between the exterior surface of dampener 100 and the inner surface of a surrounding pipe or wellbore), preserving the relative position of dampener 100, preserving preload on energy storage devices (spring assembly 20 and compression spring 25), and thus preserving the performance characteristics of dampener 100 when responding to a given shock or impact event.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for dampening forces encountered from shock events downhole within a wellbore comprising:

a) installing a shock dampener apparatus within a downhole assembly, wherein said shock dampener apparatus has a first end and a second end and an internal fluid flow path configured to permit fluid flow through said shock dampener apparatus from said first end to said second end, and wherein said shock dampener apparatus further comprises:

i) a substantially cylindrical housing having a first end, a second end and a central through bore extending from said first end to said second end;

ii) a central mandrel having a first end, a second end, a central bore extending from said first end through a portion of said mandrel, and at least one port extending from said central bore to an external surface of said central mandrel, wherein said central mandrel is slidably received in said first end of said housing and moveably disposed within said central bore of said housing, and wherein an annular space is formed between said central mandrel and said housing;

iii) a first compression spring configured to bias said housing when said shock dampener is exposed to compressive forces along the longitudinal axis of said housing;

iv) a second compression spring configured to bias said central mandrel when said shock dampener is exposed to tensile forces along the longitudinal axis of said housing; and v) a fluid diversion member attached to said second end of said housing, said fluid diversion member comprising a barrel, a flow bore, at least one first channel extending from said annular space to said flow bore, and at least one second channel extending from said barrel to an external surface of said fluid diversion member;

b) absorbing downhole shock forces, wherein the length of said shock dampener apparatus changes in response to said shock forces but the volume of said internal flow path does not change; and c) displacing a predetermined volume of fluid between an inner chamber in said shock dampener apparatus and an annular space formed between said shock dampener apparatus and a surrounding pipe or the wellbore.

2. The method of claim 1, further comprising a check valve or flow control orifice in said at least one second channel.

3. The method of claim 1, wherein torque force applied to said first end of said shock dampener apparatus is transferred to said second end of said shock dampener apparatus.

4. A shock dampener apparatus comprising:

a) a substantially cylindrical housing having a first end, a second end and a central through bore extending from said first end to said second end;

b) a central mandrel having a first end, a second end, a central bore extending from said first end through a portion of said mandrel, and at least one port extending from said central bore to an external surface of said central mandrel, wherein said central mandrel is slidably received in said first end of said housing and moveably disposed within said central bore of said housing, and wherein an annular space is formed between said central mandrel and said housing;

c) a first compression spring configured to bias said housing when said shock dampener is exposed to compressive forces along the longitudinal axis of said housing;

d) a second compression spring configured to bias said central mandrel when said shock dampener is exposed to tensile forces along the longitudinal axis of said housing; and e) a fluid diversion member attached to said second end of said housing, said fluid diversion member comprising a barrel, a flow bore, at least one first channel extending from said annular space to said flow bore, and at least one second channel extending from said barrel to an external surface of said fluid diversion member.

5. The shock dampener apparatus of claim 4, further comprising a check valve or flow control orifice disposed within said at least one second channel.

6. The shock dampener apparatus of claim 4, wherein the second end of said central mandrel is moveably received within said barrel forming a fluid chamber, and further comprising a fluid pressure seal formed between said external surface of said central mandrel and an inner surface of said barrel.

7. The shock dampener of claim 6, wherein the volume of said fluid chamber decreases when said shock dampener apparatus contracts in response to compressive forces.

8. The shock dampener of claim 6, wherein the volume of said fluid chamber increases when said shock dampener apparatus extends in response to the tensile forces.

9. The shock dampener apparatus of claim 4, further comprising a torque transfer assembly.

10. The shock dampener apparatus of claim 9, wherein said torque transfer assembly comprises:

a) a key housing, operationally attached to said substantially cylindrical housing, having a central through bore and at least one transverse slot, wherein said central mandrel is moveably disposed within said bore;

b) at least one elongated groove disposed in said external surface of said central mandrel, wherein said at least one elongated groove is aligned with said at least one transverse slot; and c) a key slidably disposed within each of said at least one elongated groove and fixedly received within said at least one aligned transverse slot.

11. A shock dampener apparatus comprising:

a) a substantially cylindrical housing having a first end, a second end and a central through bore extending from said first end to said second end;

b) a central mandrel having a first end, a second end, a central bore extending from said first end through a portion of said mandrel, and at least one port extending from said central bore to an external surface of said central mandrel, wherein said central mandrel is slidably received in said first end of said housing and moveably disposed within said central bore of said housing, and wherein an annular space is formed between said central mandrel and said housing;

c) a first compression spring configured to bias said housing when said shock dampener is exposed to compressive forces along the longitudinal axis of said housing;

d) a second compression spring configured to bias said central mandrel when said shock dampener is exposed to tensile forces along the longitudinal axis of said housing;

e) a fluid diversion member attached to said second end of said housing, said fluid diversion member comprising a barrel, a flow bore, at least one first channel extending from said annular space to said flow bore, and at least one second channel extending from said barrel to an external surface of said fluid diversion member, and wherein the second end of said central mandrel is moveably received within said barrel forming a fluid chamber;

f) a fluid pressure seal formed between said external surface of said central mandrel and an inner surface of said barrel;

g) a check valve or flow control orifice disposed within said at least one second channel;

h) a key housing, operationally attached to said substantially cylindrical housing, having a central through bore and at least one transverse slot, wherein said central mandrel is moveably disposed within said bore;

i) at least one elongated groove disposed in said external surface of said central mandrel and aligned with said at least one transverse slot; and j) a key slidably disposed within each of said at least one elongated groove and fixedly received within said at least one aligned transverse slot.

12. The shock dampener of claim 11, wherein the volume of said fluid chamber decreases when said shock dampener apparatus retracts in response to compressive forces.

13. The shock dampener of claim 11, wherein the volume of said fluid chamber increases when said shock dampener apparatus extends in response to the tensile forces.

14. The shock dampener of claim 11, wherein said shock dampener apparatus is configured to be installed between a pulser having a servo valve, and a downhole mud valve.

* * * * *